United States Patent [19]

Egger et al.

[11] Patent Number: 4,657,408

[45] Date of Patent: Apr. 14, 1987

[54] BASE ELEMENT FOR A WRISTWATCH

[75] Inventors: Joseph Egger, Pforzheim; Adolf Sedlak, Wurmberg, both of Fed. Rep. of Germany

[73] Assignee: Timex Corporation, Waterbury, Conn.

[21] Appl. No.: 457,820

[22] Filed: Jan. 13, 1983

[30] Foreign Application Priority Data

Feb. 26, 1982 [DE] Fed. Rep. of Germany ..... 3206942

[51] Int. Cl.[4] ..... G04B 37/00

[52] U.S. Cl. ..... 368/317; 368/309

[58] Field of Search ..... 368/88, 280, 309, 318, 368/317, 300; 206/18; 29/177, 179; 428/683, 624–626

[56] References Cited

U.S. PATENT DOCUMENTS

| | | | |
|---|---|---|---|
| 2,359,719 | 10/1944 | Simpson | 29/177 |
| 2,468,053 | 4/1949 | Fix et al. | 368/318 |
| 2,685,164 | 8/1954 | Grillet et al. | 368/318 |
| 3,990,227 | 11/1976 | Matsuura | 368/317 |
| 4,264,969 | 4/1981 | Walker et al. | 368/88 |
| 4,421,423 | 12/1983 | Lederrey | 368/291 |
| 4,496,246 | 1/1985 | Ota et al. | 368/88 |
| 4,534,660 | 8/1985 | Laesser | 368/318 |
| 4,603,978 | 8/1986 | Brenk | 368/309 |

FOREIGN PATENT DOCUMENTS

| | | | |
|---|---|---|---|
| 2459679 | 7/1975 | Fed. Rep. of Germany | 368/318 |
| 1012194 | 7/1952 | France | 368/318 |
| 67674 | 6/1977 | Japan | 368/88 |
| 98878 | 8/1978 | Japan | 368/300 |
| 16890 | 2/1981 | Japan | 368/309 |
| 70791 | 5/1915 | Switzerland | 368/318 |

*Primary Examiner*—L. Dewayne Rutledge
*Assistant Examiner*—John J. Zimmerman
*Attorney, Agent, or Firm*—William C. Crutcher

[57] ABSTRACT

The invention relates to a base element for a wristwatch in the form of a laminate, which simultaneously serves the purpose of a movement plate or frame and a case back and which consists of two integrally joined plates, these plates being bonded together in particular by means of a foil using ultrasonic heat-sealing. Such a base element may be manufactured with high precision simply and cheaply and has good stability, especially when a circular edge is folded to the inside of one of the plates of the base element for the purpose of reinforcement.

2 Claims, 2 Drawing Figures

BASE ELEMENT FOR A WRISTWATCH

BACKGROUND OF THE INVENTION

Figure 1:
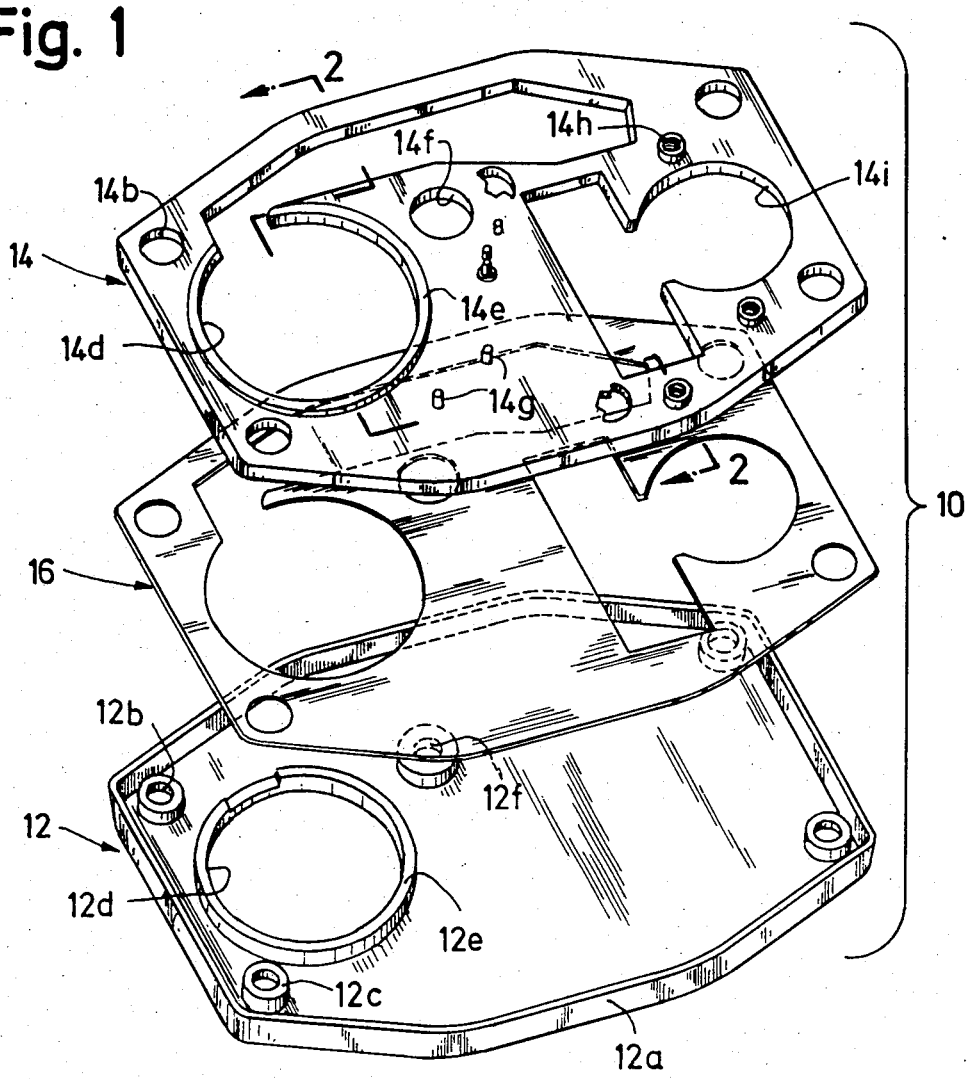

The invention relates to a base element simultaneously serving the purpose of a movement plate and a case back for a wristwatch.

Base elements of this type are already known and normally consist of a simple piece of material, the outside of which is constructed such that it can serve as the case back of a watch and the inside of which is worked such that it can form the movement plate or frame of the watch movement. The advantage of such a base element forming both the case back and the movement plate is that it enables extremely flat wristwatches to be made, in particular expensive watches intended as pieces of jewelry, in which case the base element is made entirely of a precious metal such as gold. The disadvantage of the known concept is, however, the fact that it is relatively complicated and costly to work the inside, in particular, of the base element, which is later to serve as movement plate. For example, the customary openings in the movement plate, which would normally be simply stamped or drilled, have to be milled out with difficulty and great precision.

Proceeding on the basis of this prior art the object underlying the invention is to propose an improved base element of the type under consideration, which is comparatively easy and cheap to produce even with movement plate elements of high precision.

This object is accomplished according to the invention by a base element of the type described at the beginning, which is characterized by two integrally joined plates.

The basic idea behind the present invention may, therefore, be seen in the fact that, first of all, two relatively simple constructional parts are quickly and cheaply produced using normal procedures and normal apparatus and that these two constructional parts are then joined together to form an integral constructional element which forms the combined base element simultaneously serving the purpose of a case back and a movement plate or frame. Furthermore, the plate members may be of different materials, each suited to its best purpose.

The two plates may, to begin with, be joined together purely mechanically in a positive connection in that, for example, tongues integrally formed with one of the constructional elements are wrapped around the other constructional element to form an integral base element.

It has, however, proven to be particularly advantageous to have the two plates of the base element according to the invention bonded together. It has proven to be an especially favorable method of bonding to have a plastics foil made from thermoplastic material laid between the two plates and for these two plates then to be bonded with the aid of the plastics foil by using pressure and heat, preferably by means of ultrasonic heat-sealing. In this way the bonding between the two plates is very even and occurs over the entire surface. The foil may also have corresponding spaces for the openings in the two plates, in particular in the inner plate, so that later, according to the thickness of the material used for the inner plate, the full height of these openings may be utilized for elements of the watch movement.

Concerning the manufacture of the plates themselves it has proven advantageous to have these made as parts stamped from sheet material, in particular high-quality stainless steel, since stamped metal parts of this type can be produced relatively cheaply but still with high precision. The outer plate for expensive watches intended as pieces of jewelry can also be produced from a relatively thin sheet of gold or other precious metal. If desired, the inner plate can be stamped from less expensive material, such as brass.

If the outer plate is manufactured as a stamped metal part it is also favorable to have these parts made with openings, for example for the battery and screw apertures for screwing the base element and bezel together, such that a collar surrounds the relevant opening on the inside of the outer plate. This collar can later serve to center the inner plate and, if necessary, the foil when the base element is assembled.

Finally, the construction of the base element from two separately manufactured plates offers favorable possibilities of providing attachment elements on these plates at manufacture for later attaching watch straps.

DRAWINGS

Figure 2:
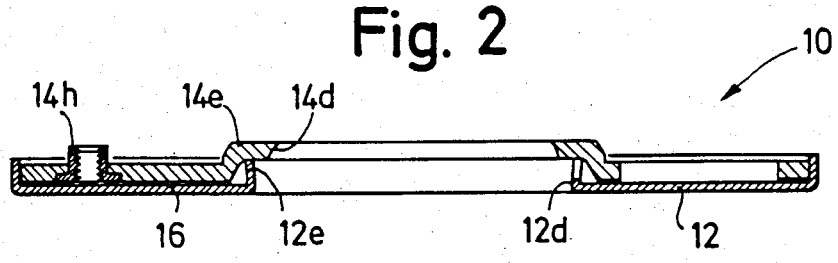

Further details and advantages of the invention are explained in the following on the basis of drawings and/or are the subject matter of subclaims. The drawings show:

FIG. 1 a perspective exploded illustration of a preferred embodiment of a base element according to the invention, and FIG. 2 a cross section through the base element according to FIG. 1 along the line 2—2 in this figure.

SUMMARY OF THE INVENTION

Briefly stated, the invention is practiced by providing a laminated base element in a watch which serves both as the movement plate and as the case back, wherein the base element comprises two plates integrally joined together. Preferably these are joined by bonding together with a foil member of thermoplastics material.

BACKGROUND OF THE INVENTION

FIG. 1 shows in detail that a base element 10 according to the invention is constructed substantially from three main elements, namely an outer plate 12, an inner plate 14 and a foil 16.

When the watch is fully assembled the outer plate 12 of the base element 10 forms the outside of the base element or rather an almost conventional case back and has, in the embodiment shown, a peripheral edge **12*a* running around its periphery and facing inwards, in the case of FIG. 1 upwards. In addition, the outer plate 12 has screw openings 12*b* provided in the area of its four corners, each of these being surrounded by a circular, centering collar 12*c*. Moreover, the outer plate 12 has a battery opening 12*d* which is also surrounded by a collar 12*e*. Finally, additional openings, which can also be encircled by a collar, may be provided on the outer plate 12, for example for receiving the actuating elements of operating switches. This type of opening 12*f*** is shown in the drawings.

It is clear from the drawings and the foregoing description that it is possible to manufacture the outer plate 12 cheaply as a part stamped from sheet material.

The inner plate 14 may also be stamped from sheet material and is disposed on the inside of the base element when the watch is fully assembled. As shown in particular in FIG. 1, the outer contours of the inner plate 14 correspond to the contours of the outer plate 12 determined by the edge 12*a*. In addition, the inner plate 14 also has openings 14*b*, 14*d* and 14*f* corresponding to the openings 12*b*, 12*d* and 12*f*, the battery opening 14*d* again being surrounded by an edge 14*e*, as clearly shown in FIG. 2. The two plates 12 and 14 therefore fit exactly into each other; the collar 12*c* surrounding each of the screw openings 12*b* preferably has an outer diameter corresponding to the inner diameter of openings 14*b* so that these collars 12*c* may, as a whole, serve the purpose of centering or positioning the inner plate 14 particularly exactly relative to the outer plate 12.

Apart from the openings already mentioned the inner plate 14 has additional openings which are not described in detail but serve to receive parts of the watch movement or drive motor and/or printed circuit elements, etc. Furthermore, lugs 14*g* or threaded bushings 14*h* are pressed into the inner plate 14, these elements all being preferably attached before final assembly of the base element 10.

The base element 10 is then finally assembled according to the invention such that a foil 16 made from a thermoplastic plastics material is placed between the inside of the outer plate 12 and the outside of the inner plate 14. The elements 12 to 16 are then heat-sealed under pressure, preferably by means of ultrasonic heat-sealing. The plastics foil 16 is preferably provided with openings 16*b*, 16*d*, etc. which correspond to the relevant openings in the inner plate 14. This will, on the one hand, make it easier for elements 12 to 16 to be fitted exactly into each other while, at the same time, the height of the openings, e.g., the opening 14*i* serving to receive watch movement components, corresponds to the full thickness of the plates.

It is clear from the foregoing description that, according to the invention, a base element is obtained, preferably in the form of a laminate, which is very flat but still has considerable mechanical strength, to which not only the peripheral edge 12*a* in particular of the outer plate 12 but also the collars provided on the inside of this plate, in particular collar 12*e* surrounding the battery opening, contribute. The laminate structure of the base element enables a bayonet catch to be realized in a simple way for a battery cover (not illustrated) provided for closure of the battery opening. The pins provided around the circumference of this cover can engage in corresponding openings in the collar 12*e*, which may be easily provided during manufacture before the collar is folded to the inside of the outer plate.

What is claimed is:

1. A laminated base element simultaneously serving the purpose of movement plate and a caseback for a wristwatch comprising two integrally joined plates, said plates being bonded together by means of a separate foil disposed between them made out of a thermoplastic material, wherein one of said plates is an inner plate comprising a stamped movement plate element comprising the necessary openings, bores and the like, and wherein the other of said plates is an outer plate designed as a caseback having an upturned peripheral edge running around its periphery and facing inward and surrounding said inner plate, said base element further including screw openings provided in its corners to receive fastening screws, which serve to provide a screw connection between the base element and the bezel of the watch, wherein the screw openings are defined as openings stamped into said outer plate and having a circular centering collar on the inside of said outer plate.

2. Base element according to claim 1, wherein said plates are bonded by means of the thermoplastic foil by ultrasonic heat-sealing.

* * * * *